United States Patent [19]

Hamsher, Jr. et al.

[11] Patent Number: 4,627,674

[45] Date of Patent: Dec. 9, 1986

[54] TRI-LEAD CONNECTOR

[75] Inventors: Wilbur A. Hamsher, Jr., New Cumberland; Raymond V. Pass, Camp Hill, both of Pa.

[73] Assignee: AMP Incorporated, Harrisburg, Pa.

[21] Appl. No.: 744,281

[22] Filed: Jun. 12, 1985

Related U.S. Application Data

[63] Continuation of Ser. No. 485,922, Apr. 18, 1983, abandoned.

[51] Int. Cl.[4] ..... H01R 4/66

[52] U.S. Cl. ..... 339/14 P; 339/99 R; 339/196 M; 339/75 M

[58] Field of Search ..... 339/177 R, 177 E, 14 R, 339/14 P, 176 MF, 103, 107, 97 R, 97 P, 98, 99 R, 74 R, 196 M

[56] References Cited

U.S. PATENT DOCUMENTS

| | | | |
|---|---|---|---|
| 3,086,074 | 4/1963 | Just et al. | 174/148 |
| 3,316,523 | 4/1967 | Trangmar | 339/107 |
| 3,323,099 | 5/1967 | Spera | 339/192 |
| 3,325,770 | 6/1967 | Hammell et al. | 339/176 |
| 3,533,044 | 10/1970 | Bauman et al. | 339/14 R |
| 3,673,542 | 6/1972 | DiStefano et al. | 339/14 R |
| 3,705,376 | 12/1972 | Kinkaid et al. | 339/30 |
| 3,796,987 | 3/1974 | Kinkaid et al. | 339/217 S |
| 3,874,762 | 4/1975 | Shott et al. | 339/91 R |
| 3,879,099 | 4/1975 | Shaffer | 339/176 MF |
| 4,040,703 | 8/1977 | Shaffer et al. | 339/99 R |
| 4,083,615 | 4/1978 | Volinskie | 339/176 MF |
| 4,113,338 | 9/1978 | Spaulding | 339/97 R |
| 4,225,208 | 9/1980 | Brandeau et al. | 339/176 MF |
| 4,236,778 | 2/1980 | Hughes et al. | 339/107 |
| 4,269,466 | 5/1981 | Huber | 339/176 MF |
| 4,278,314 | 7/1981 | Moser et al. | 339/176 MF |
| 4,367,004 | 1/1983 | Fujiura et al. | 339/97 R |
| 4,367,909 | 1/1983 | Shatto et al. | 339/14 R |
| 4,422,709 | 12/1983 | Croci et al. | 339/176 MF |

*Primary Examiner*—Gil Weidenfeld
*Assistant Examiner*—David L. Pirlot
*Attorney, Agent, or Firm*—Katherine A. Nelson; Anton P. Ness

[57] ABSTRACT

An improved connector for terminating tri-lead cable includes a housing carrying a signal terminal and a ground terminal each capable of making engagement with a respective conductor of one or a pair of tri-lead cables. The connector also includes a pair of hermaphroditic covers each of which receives therein a respective tri-lead cable with the conductors thereof profiled to positions enabling termination by the terminals. The covers secure the termination sections of the terminals therewithin and are movable along with the terminals with respect to the housing to effect unlocking of the signal terminal from a mating pin terminal of a printed circuit board, so that the connector assembly is removable from the board, the ground terminal being removably engageable with a mating ground rail of the board.

23 Claims, 11 Drawing Figures

108
22
36
20
30
34
32
18
114
132
138
146
142
26
28
106
116
134
144
136
24
122
118
120

TRI-LEAD CONNECTOR

This application is a continuation of application Ser. No. 485,922 filed Apr. 18, 1983 now abandoned.

The present invention relates to a disengageable electrical connector for connecting tri-lead cables to respective pin and ground members of a circuit board or the like.

There are a wide variety of electrical connectors that have been used for connecting multi-conductor cables to panel boards, printed circuits, and the like, of data processing systems. However, a problem has arisen connected with micro-miniaturization of circuitry which requires that such connectors be capable of mating on a high density array and thus the connectors are of such size as to frequently make individual insertion and extraction extremely difficult. One attempt to provide an improved electrical connector is shown in U.S. Pat. No. 3,874,762 which shows an electrical connector particularly designed for use with a tri-lead type of cable. A single contact is arranged to make an insulation piercing engagement with the outer two ground conductors of the tri-lead cable while a single contact is arranged to engage only the central signal conductor. The first contact has a single mating portion which can be polarized or of a slightly different configuration from the mating portion of the second contact to effect correct mating of the connector. U.S. Pat. No. 3,673,542 also shows an electrical connector for use with tri-lead type of cable. This connector includes at least two fork connectors one of which is crimped to the signal or center lead and the other two of which are crimped to the ground or outer leads of the cable. Thus the assembly of this connector would require separation of the conductors of the cable, two crimping operations, and insertion of the contacts into their respective portions of the housing. This patent is actually an improvement over a somewhat similar earlier arrangement which is disclosed in U.S. Pat. No. 3,533,044. A further improvement in the terminals and the housing itself is found in U.S. Pat. No. 4,040,703. In this patent the housing is shown so designed that it is capable of being ganged together in a single holder to facilitate the insertion and extraction of a group of connectors.

The present invention overcomes the shortcomings of the prior art by providing an improved miniaturized connector for terminating tri-lead cable which connector includes a two part housing formed by a main body and a pair of hermaphroditic covers, the main body receiving therein a ground terminal capable of terminating the ground conductors of the tri-lead cable and a signal terminal capable of terminating the signal conductor and employing an insulation piercing technique. The signal terminal further includes means to positively grippingly engage an associate pin terminal. Both terminals are capable of terminating single tri-lead cables as well as pairs of tri-lead cables.

An example of the present invention will now be described by way of example with reference to the accompanying drawings in which.

Figure 1:
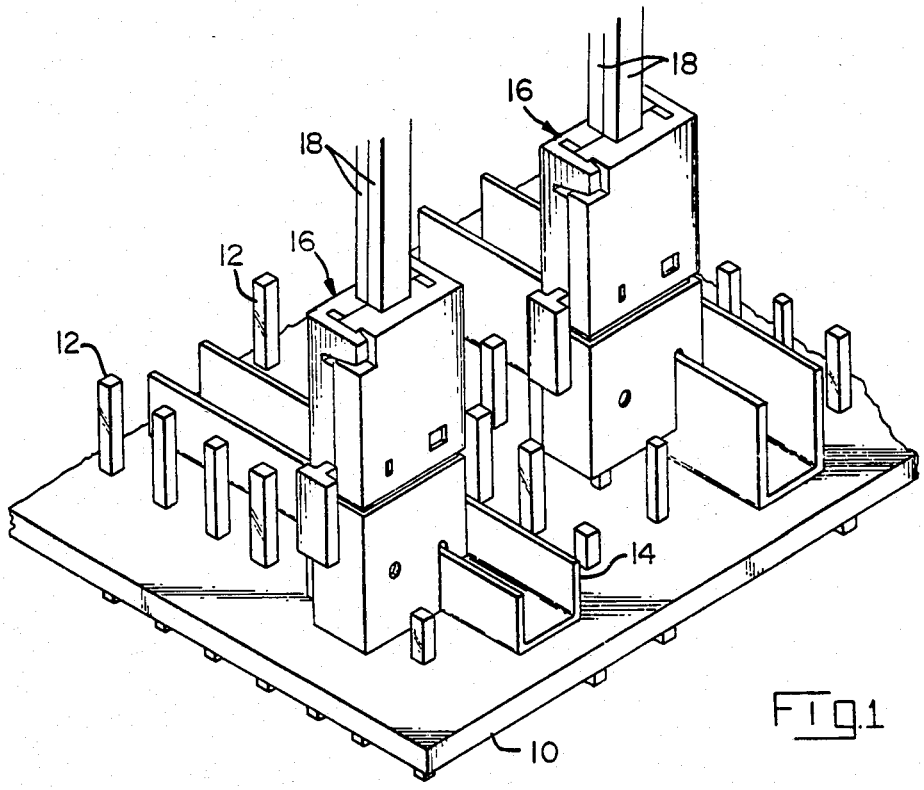
FIG. 1 is a fragmentary perspective view showing a portion of a circuit board having terminal pins and ground rails mounted thereon and the subject invention making interconnection therewith.

The use of the present invention can best be understood from FIG. 1, which shows a portion of a circuit board 10 having a plurality of pin terminals 12 arranged in rows on opposite sides of elongated channel shaped ground bars 14. The subject connector 16 is used to terminate two tri-lead cables 18 and make connection between a pin 12 of one row and an adjacent side of a channel shaped ground bar 14.

Figure 2:
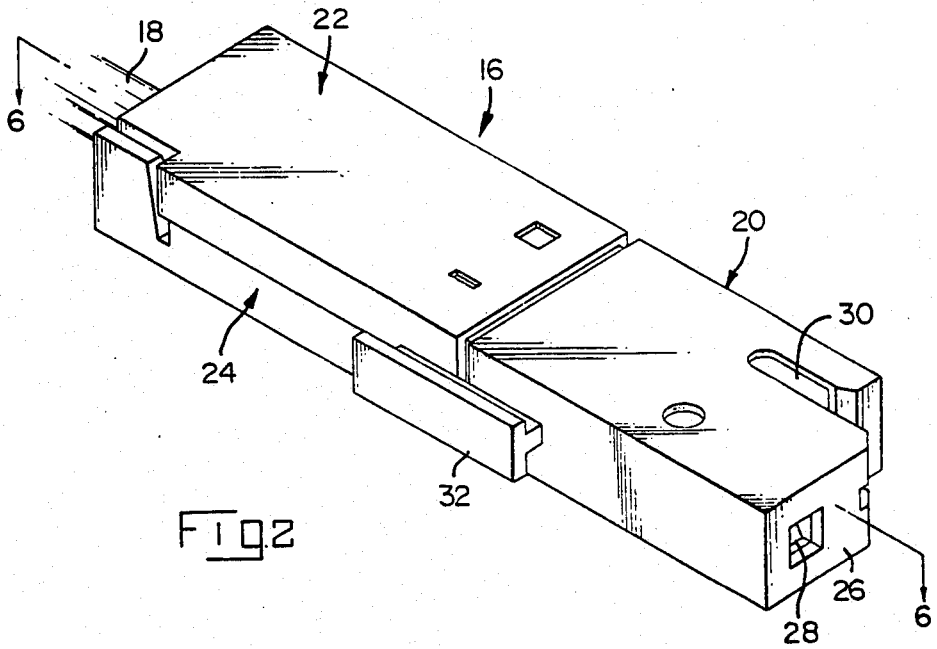
FIG. 2 is a perspective view of a connector according to the present invention.

The subject connector 16 is shown in FIG. 2 and has a housing 20 and a pair of mating hermaphroditic covers 22, 24. Covers 22, 24 are movable relative to housing 20 to cause relative movement of signal terminal 34 and ground terminal 36 with housing 20 (FIGS. 7 and 8) to effect unlocking of signal terminal 34 from a pin terminal 12. The housing has a mating face 26 which has a stepped profile, as can best be appreciated from FIGS. 6 and 7. The mating face 26 includes a pin aperture 28 and a transverse slot 30. The housing also includes an integral profiled extension 32 which can be used for the holder of above mentioned U.S. Pat. No. 4,040,703.

Figure 3:
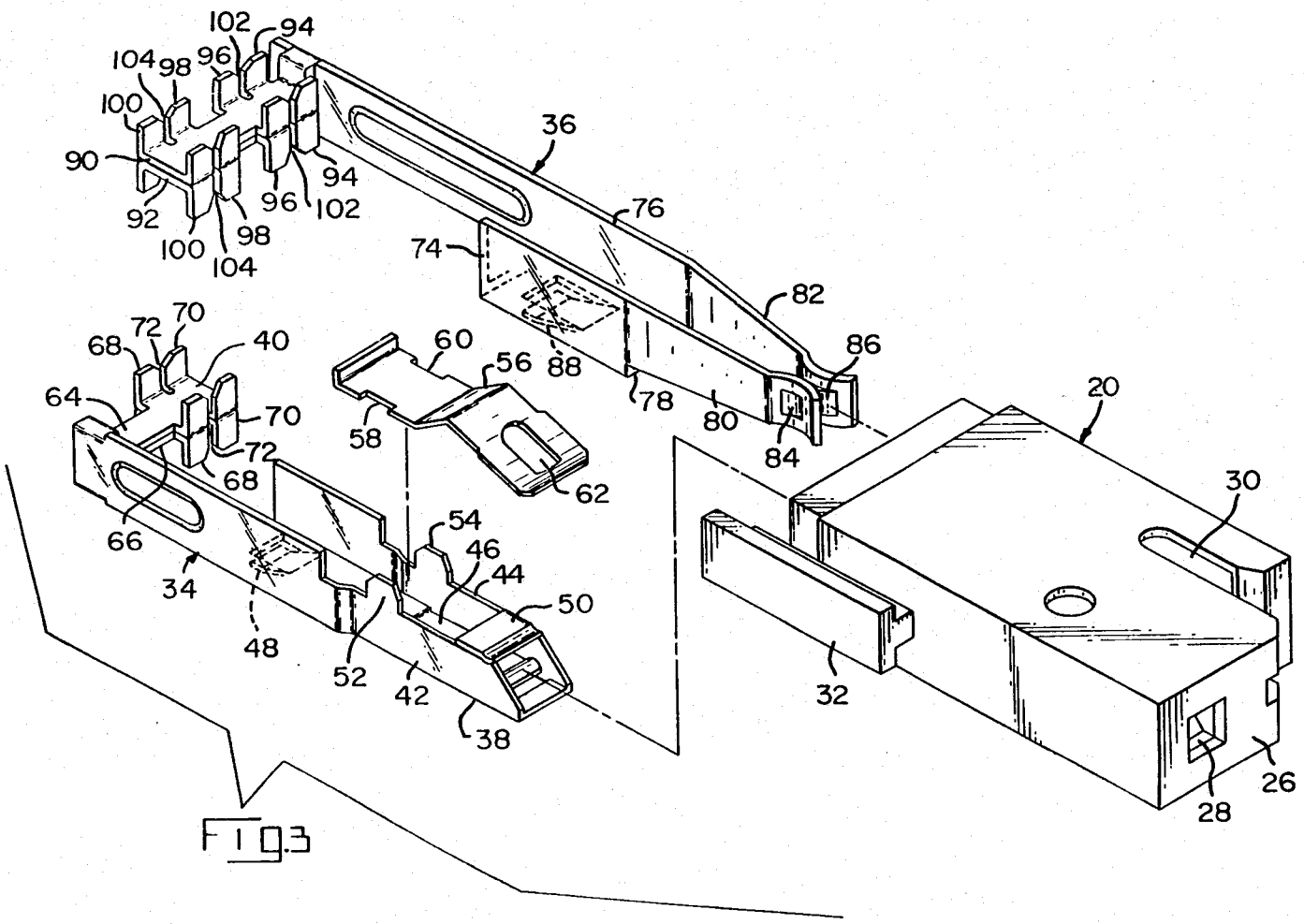
FIG. 3 is a perspective view of the housing of the present invention with the signal and grounc terminals exploded therefrom.

FIG. 3 shows the signal terminal 34 and ground terminal 36 exploded from the housing 20. The signal terminal 34 includes a two piece pin engaging front end 38 and an insulation piercing conductor engaging rear end 40. The front end 38 is generally channel shaped including a pair of parallel spaced side walls 42, 44 extending upwardly from opposite rear marginal portions of a base web 46. Front end 38 forms a cantilever beam providing normal contact force to a pin terminal received therein. A locking lance 48 is struck from base web 46. A bridge 50 is formed integral with one side wall and spans the channel to rest on the opposite side wall. Each side wall 42, 44 further includes a mounting lug 52, 54. A metal spring member 56 completes front end 38. This member 56 is profiled to have recesses 58, 60 which receive the respective lugs 52, 54 and an elongated aperture 62 which provides axial access to the channel. The rear end 40 of signal terminal 34 is formed by a pair of cantilever arms 64, 66 which extend from opposite margins of sidewall 42 and are folded to lie back-to-back, each having at least one pair of ears 68, 70 extending normal to the plane thereof and defining therebetween an insulation piercing conductor engaging slot 72.

Ground terminal 36 has a pair of spaced side walls 74, 76 extending normal from opposite marginal edges of a base web 78 and a pair of cantilever beam arms 80, 82 extend forwardly from the respective side walls. The arms 80, 82 are profiled to have closely spaced contacting portions 84, 86. A locking lance 88 is struck from base web 78. Sidewall 76 is of greater length than the sidewall 74 and includes, at its rear end, a pair of arms 90, 92 which extend from opposite margins and are folded to lie back-to-back, each arm being provided with at least two pairs of ears 94, 96, 98, 100 spaced therealong, each pair of ears defining a respective conductor engaging slot 102, 104.

Figure 4:
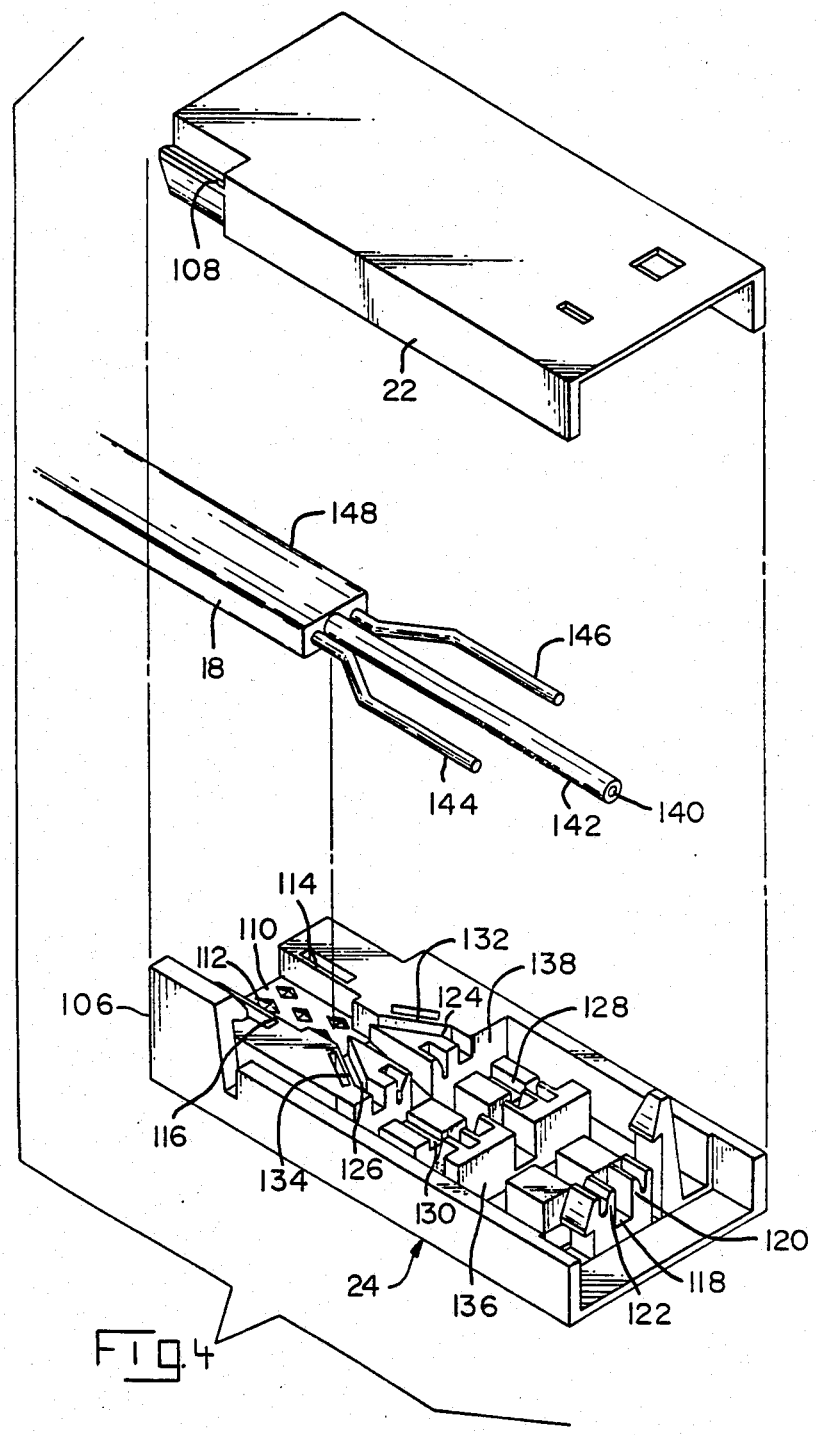
FIG. 4 is a perspective view of the hermaphroditic covers of the subject invention exploded from a tri-lead cable.
Figure 5:
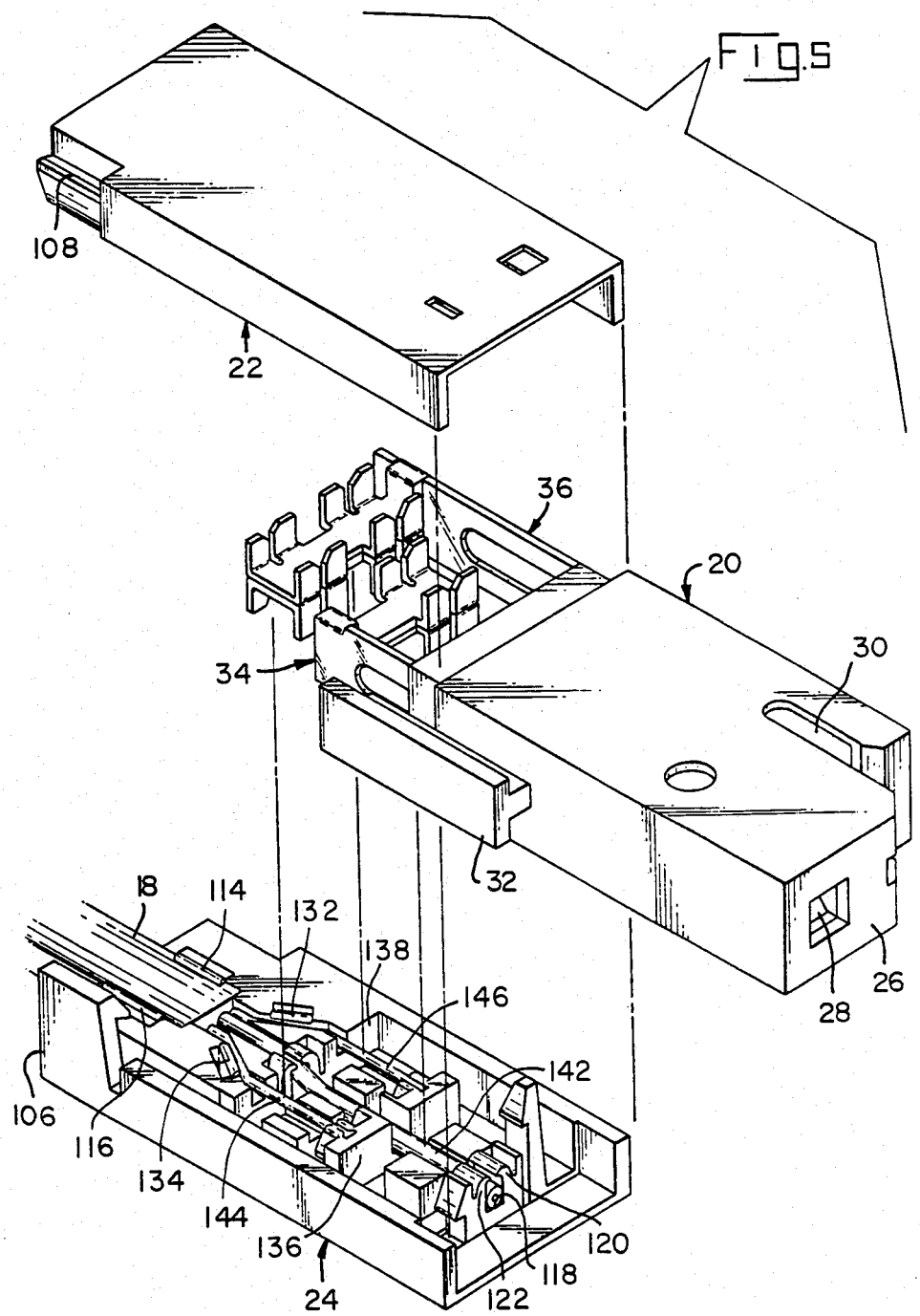
FIG. 5 is a perspective view of the subject invention with the hermaphroditic covers exploded therefrom.

Turning now to FIGS. 4 and 5, the details of the covers 22, 24 are most readily apparent from these two Figures. Each cover 22, 24 includes at least one latching lug 106 and corresponding detent 108. Each cover 22, 24 further includes a cable entry 110 preferably provided with strain relief projections 112 and side wall portions 114, 116 which are profiled to be readily deformed to grip the tri-lead cable 18, as shown in FIG. 5. Each cover is profiled to have a central signal conductor channel 118, at least a portion of which is defined by deformable walls 120, 122 to grip the insulated signal conductor, as shown in FIG. 5. Each cover also includes a pair of shorter, ground conductor channels each of which includes an initial diverging portion 124, 126 and a pair of parallel spaced portions 128, 130. At least one wall 132, 134 of each ground channel is deformable to grip the respective ground conductor 144, 146 therein, as shown in FIG. 5. Each cover also includes an L-shaped signal terminal receiving passage 136 and a corresponding L-shaped ground terminal receiving passage 138 on the opposite side and to the rear of passage 136.

The tri-lead cable 18 is of a particular configuration having a central signal conductor 140 coated with insulation 142 and flanked by a pair of ground conductors 144, 146. All three conductors are then enclosed in an extruded insulation 148.

Figure 6:
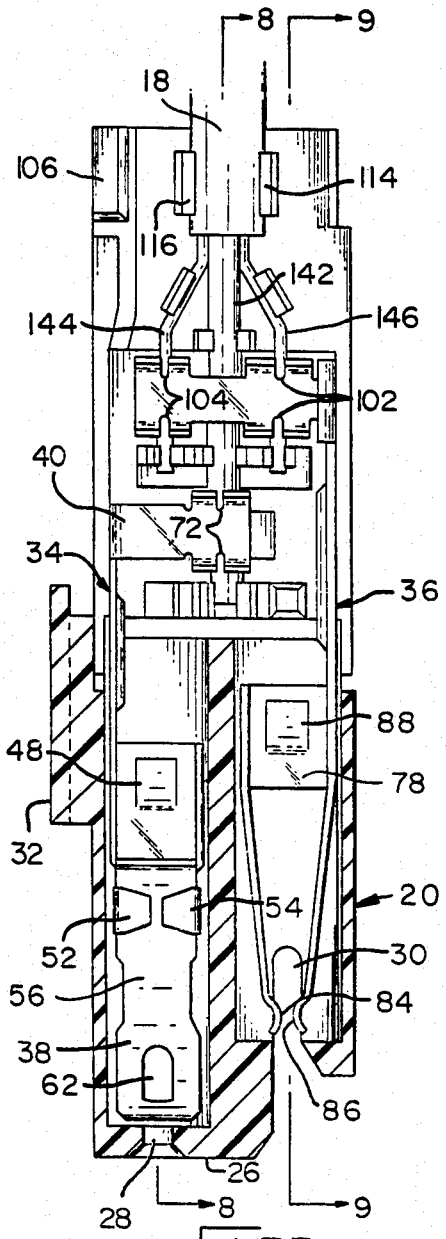
FIG. 6 is a part plan view, part longitudinal section view taken along line 6—6 of FIG. 2.
Figure 8:
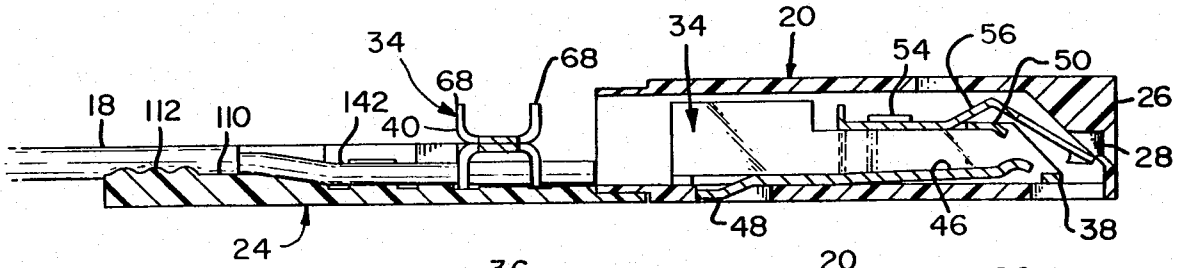
FIG. 8 is a section taken generally along line 8—8 of FIG. 6.
Figure 9:
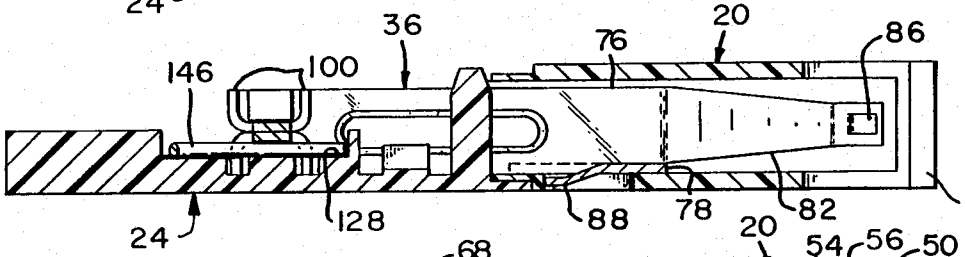
FIG. 9 is a section taken generally along line 9—9 of FIG. 6.

FIGS. 6, 8, and 9 best illustrate how the terminals are mounted in the respective housing and receive the cables which have been preformed into the respective covers. It will be especially appreciated from FIGS. 8 and 9 that the tri-lead cable 18 is mounted in a secure fashion in a single cover thereby allowing a second tri-lead cable (not shown) to be mounted in the other of the hermaphroditic cover pair so that a pair of tri-lead cables may be simultaneously terminated by a single connector.

Figure 7:
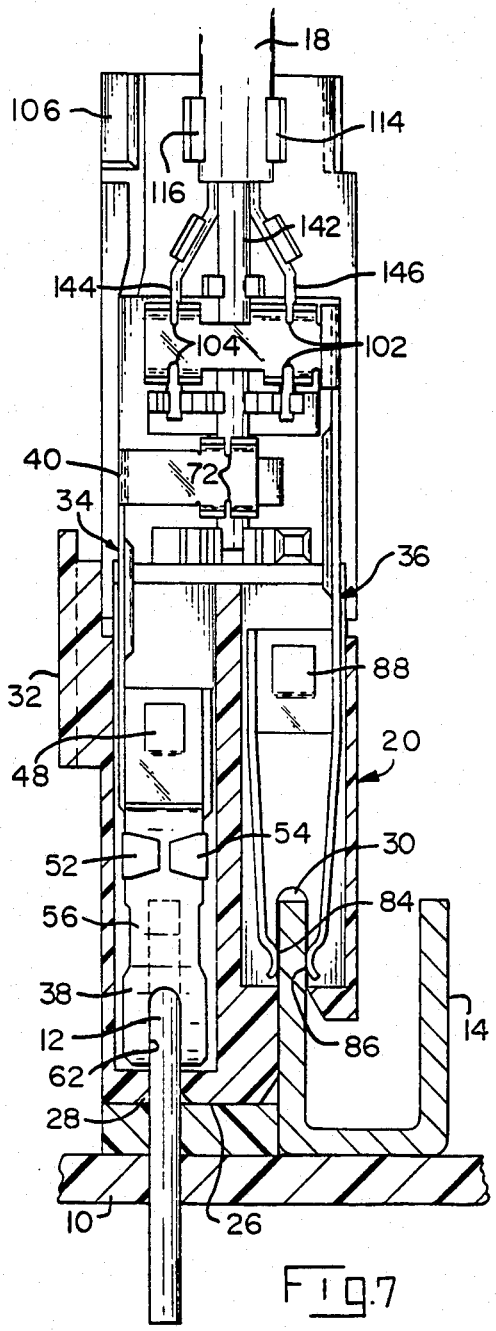
FIG. 7 is a section view, similar to FIG. 6, showing the subject connector in a mated condition.

FIG. 7 illustrates how the present invention makes contact with the respective pin terminal 12 and bus bar 14. The pin terminal 12 passes through the aperture 62 to be gripped by spring member 56 much in the fashion of the terminal described in U.S. Pat. Nos. 3,705,376 and 3,796,987, the disclosures of which are incorporated herein by reference.

Figure 10:
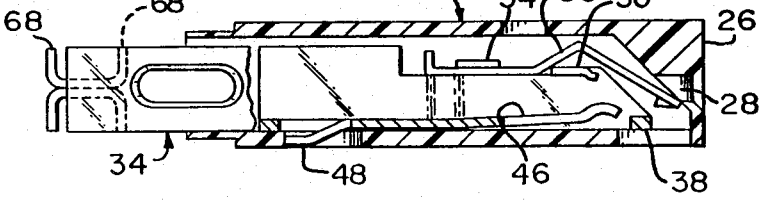
FIG. 10 is a section similar to FIG. 8 but without the cable and the cover.
Figure 11:
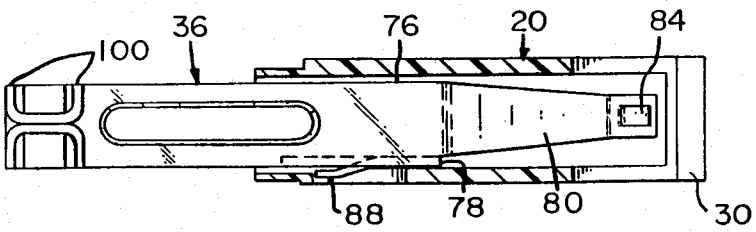
FIG. 11 is a section similar to FIG. 9 but without the cover and the cable.

FIGS. 10 and 11 show how the housing of the present invention can be preloaded with the terminals and the cable then terminated in a mass terminating technique simply by the applying of the cable lead and covers to the appropriate sides thereof.

We claim:

1. An electrical connector for terminating tri-lead cable with terminals enabling electrical connection with further electrical terminals comprising:

a housing of rigid insulative material having a mating face and an oppositely directed rear surface with a pair of profiled terminal passages extending between said face and said surface;

a signal terminal having a front mating portion profiled to make locking engagement with an associate pin terminal and a signal conductor engaging rear portion extending from said rear surface normal to the axis of said front mating portion;

a ground terminal having a forward portion received in the other of said terminal passages and having a front mating portion profiled to engage a respective grounding bar and a ground conductor engaging rear portion extending from said rear surface normal to the axis of said front mating portion and having at least two spaced ground conductor engaging portions thereon; and a pair of covers securable together which secure the signal and ground terminals therein, each cover having a central signal conductor channel and a pair of profiled ground conductor channels to each side of said signal conductor channel, each said channel having an L-shaped terminal receiving passage a portion of which extends normal to and intersects the axis of a respective channel whereby leads of a cable will be profiled by said channels and terminated by said terminals;

said covers being axially movable relative to said housing to cause relative movement of said terminals within said housing to effect unlocking of said signal terminal.

2. An electrical connector according to claim 1 wherein said housing further comprises:

means to gang a number of connectors together for unit operation.

3. An electrical connector according to claim 1 wherein said mating portion of said signal terminal comprises:

a pair of parallel spaced side walls extending normal to marginal portions of a central web, each said sidewall having at least one free edge, a cantilever beam formed by said web between said sidewalls at the mating end of said terminal, a spring member secured to free edges of said side walls with one end of said spring member depending between said walls, and an opening formed in the end of said spring member lying between the walls whereby a mating pin terminal is received through said opening with normal force applied thereto by said cantilever beam.

4. An electrical connector according to claim 1 wherein said signal conductor engaging rear portion of said signal terminal comprises:

a plate portion defining an insulation piercing, conductor engaging slot.

5. An electrical connector according to claim 1 wherein said ground terminal has a front mating portion comprising:

a pair of parallel spaced side walls extending normal to marginal edges of a base wall, forward directed portions of each sidewall forming cantilever beams approaching each other toward their free ends to grip a planar mating member therebetween.

6. An electrical connector according to claim 1 wherein said pair of covers further comprise:

latching arms, and detents whereby said covers can be secured together.

7. An electrical connector according to claim 1 wherein each of said pair of covers has a profiled cable entry providing strain relief cable gripping in the assembled condition.

8. An electrical connector according to claim 1 wherein each said cover has wall portions adjacent each said signal conductor channel and ground conductor channel which wall portions are deformable to secure the conductors in the respective channels.

9. An electrical connector according to claim 1 wherein said conductor engaging rear portion of said signal terminal comprises:

at least one arm extending normal to and from a rear portion of a sidewall of said signal terminal, and a pair of ears extending normal to the plane of each said at least one arm defining an insulation piercing, conductor engaging slot therebetween.

10. An electrical connector according to claim 9 further comprising:

a pair of arms folded back-to-back with said ears extending in opposite directions therefrom, whereby a pair of cables can be engaged by a single terminal.

11. An electrical connector according to claim 1 wherein said ground conductor engaging rear portion comprises:

at least one arm extending normal to and from a rear portion of a sidewall of said ground terminal, and two pairs of ears extending normal to the plane of each said at least one arm, each pair of ears defining conductor engaging slot therebetween.

12. An electrical connector according to claim 15 further comprising:

a pair of arms folded back-to-back with said pairs of ears extending in opposite directions whereby a pair of cables can be engaged by a single terminal.

13. An electrical connector as set forth in claim 1 wherein said covers are hermaphroditic.

14. An electrical connector as set forth in claim 1 wherein each said ground conductor channel has a diverging portion having a wall portion deformable to secure a respective ground conductor therein.

15. An electrical connector capable of terminating a tri-lead cable and making electrical interconnection with a panel board having a plurality of rows of terminal pins and ground rails mounted thereon in parallel spaced relation, the connector connecting the signal conductor of said cable to a pin terminal and the ground conductors to a respective ground bar, said connector comprising:

a housing of rigid insulative material with a front mating face profiled to receive a pin and a portion of said ground bar therein;

a signal conductor terminal mounted in said housing and profiled to make a locking engagement with a pin terminal received therein, said signal terminal having an insulation displacing conductor engaging portion;

a ground terminal profiled to make a wiping interconnect with a respective ground bar, said ground terminal having at least two ground conductor engaging portions; and a pair of covers securable together, each profiled to receive a tri-lead cable therein with the signal conductor extending through a central signal channel and the ground conductors being received in respective ground conductor channels wherein application of said covers to said housing brings the signal and ground conductors into engagement with the respective terminals to effect the termination thereof;

said covers being axially movable relative to said housing to cause relative movement of said terminals within said housing to effect unlocking of said signal terminal.

16. An electrical connector as set forth in claim 15 wherein said covers are hermaphroditic.

17. An electrical connector for terminating tri-lead cable with terminals enabling electrical connection with further electrical terminals comprising:

a housing of rigid insulative material having a mating face and an oppositely directed rear surface with a pair of profiled terminal passages extending between said face and said surface;

a signal terminal having a front mating portion profiled to make locking engagement with an associate pin terminal and a signal conductor engaging rear portion extending from said rear surface normal to the axis of said front mating portion;

said conductor engaging rear portion being comprised of:

(a) at least one arm extending normal to and from a rear portion of a sidewall of said signal terminal, and (b) a pair of ears extending normal to the plane of each said at least one arm defining an insulation piercing, conductor engaging slot therebetween;

a ground terminal having a forward portion received in the other of said terminal passages and having a front mating portion profiled to engage a respective grounding bar and a ground conductor engaging rear portion extending from said rear surface normal to the axis of said front mating portion and having at least two spaced ground conductor engaging portions thereon;

a pair of arms folded back-to-back with said ears extending in opposite directions therefrom, whereby a pair of cables can be engaged by a single terminal; and a pair of covers securable together, which secure the signal and ground terminals therein, each cover having a central signal conductor channel and a pair of profiled ground conductor channels to each side of said signal conductor channel, each said channel having an L-shaped terminal receiving passage a portion of which passage extends normal to and intersects the axis of a respective channel whereby leads of a cable will be profiled by said channels and terminated by said terminals, said covers being axially movable relative to said housing to cause relative movement of said terminals within said housing to effect unlocking of said signal terminal.

18. An electrical connector as set forth in claim 17 wherein said covers are hermaphroditic.

19. An electrical connector for terminating tri-lead cable with terminals enabling electrical connection with further electrical terminals comprising:

a housing of rigid insulative material having a mating face and an oppositely directed rear surface with a pair of profiled terminal passages extending between said face and said surface;

a signal terminal having a front mating portion profiled to make locking engagement with an associate pin terminal and a signal conductor engaging rear portion extending from said rear surface normal to the axis of said front mating portion;

a ground terminal having a forward portion received in the other of said terminal passages having a front mating portion profiled to engage a respective ground bar and a ground conductor engaging rear portion extending from said rear surface normal to the axis of said front mating portion and having at least two spaced ground conductor engaging portions thereon;

said ground conductor engaging rear portion being comprised of:

(a) at least one arm extending normal to and from a rear portion of a sidewall of said ground terminal, and (b) two pairs of ears extending normal to the plane of each said at least one arm, each pair of ears defining a conductor engaging slot therebetween;

a pair of arms folded back-to-back with said pairs or ears extending in opposite directions whereby a pair of cables can be engaged by a single terminal; and a pair of covers securable together, which secure the signal and ground terminals therein each cover having a central signal conductor channel and a pair of profiled ground conductor channels to each side of said signal conductor channel, each said channel having an L-shaped terminal receiving passage a portion of which extends normal to and intersects the axis of a respective channel whereby leads of a cable will be profiled by said channels and terminated by said terminals, said covers being axially movable relative to said housing to cause relative movement of said terminals within said housing to effect unlocking of said signal terminal.

20. An electrical connector as set forth in claim 19 wherein said covers are hermaphroditic.

21. An electrical connector for terminating signal and ground conductor means of tri-lead cable means for electrically connecting the signal and ground conductor means to a pin terminal and a ground rail respectively of a panelboard, comprising:

dielectric housing means having parallel passageway means extending therethrough which communicate with respective opening means at a front end of a housing means into which the pin terminal and the ground rail extend;

signal terminal means disposed along one of said passageway means and including contact means in alignment with the said respective opening means for the pin terminal for electrical connection therewith;

ground terminal means disposed along the other of said passageway means and including contact member means in alignment with the said respective opening means for the ground rail for electrical connection therewith;

terminating means provided by said signal and ground terminal means for respectively terminating the signal and ground conductor means thereto;

means in which said terminating means and said signal and ground conductor means terminated thereto are insulatively mounted, said insulative mounting means and said housing means being adapted to allow limited axial movement relative to each other;

terminal-securing means on said signal and ground terminal means and said housing means securing said respective terminal means in said housing means and adapted to allow limited axial movement of said respective terminal means with respect to said housing means;

latching means on said signal terminal means which latchably engages the pin terminal when electrically connected therewith; and means in said passageway means containing said signal terminal means engageable with said latching means when said housing means is moved axially relative to said terminal means thereby causing said latching means to be unlatched from the pin terminal enabling the connector to be disconnected from the pin terminal and the ground rail.

22. An electrical connector as set forth in claim 21 wherein said dielectric housing means comprises a housing member and a pair of covers secured together, said pair of covers comprising said insulative mounting means and being axially movable with respect to said housing member.

23. An electrical connector as set forth in claim 22 wherein said covers are hermaphroditic.

* * * * *